US005219820A

United States Patent [19]

Morohoshi et al.

[11] Patent Number: 5,219,820

[45] Date of Patent: Jun. 15, 1993

[54] REVERSIBLE THERMOSENSITIVE RECORDING MATERIAL AND METHOD OF PRODUCING THE SAME

[75] Inventors: Kunichika Morohoshi, Numazu; Yoshihiko Hotta, Mishima; Yukio Konagaya, Shimizumachi; Makoto Kawaguchi, Shizuoka; Toru Nogiwa, Numazu; Akira Suzuki, Mishima, all of Japan

[73] Assignee: Ricoh Company, Ltd., Tokyo, Japan

[21] Appl. No.: 795,672

[22] Filed: Nov. 21, 1991

[30] Foreign Application Priority Data

| | | | |
|---|---|---|---|
| Nov. 22, 1990 | [JP] | Japan | 2-320231 |
| Nov. 26, 1990 | [JP] | Japan | 2-321718 |
| Nov. 26, 1990 | [JP] | Japan | 2-321720 |
| Nov. 27, 1990 | [JP] | Japan | 2-324064 |
| Nov. 27, 1990 | [JP] | Japan | 2-324065 |

[51] Int. Cl.[5] ..... B41M 5/035; B41M 5/38

[52] U.S. Cl. ..... 503/204; 427/146; 427/148; 427/150; 427/152; 503/201; 503/208; 503/209; 503/217; 503/225; 503/226

[58] Field of Search ..... 427/146, 148, 372.2, 427/384, 385.5, 388.4, 388.5, 150, 152; 428/195, 212, 323, 327, 913; 503/208, 209, 214, 217, 225, 226, 201, 204

[56] References Cited

U.S. PATENT DOCUMENTS 4,695,528 9/1987 Dabisch et al. ..... 430/290

*Primary Examiner*—B. Hamilton Hess

*Attorney, Agent, or Firm*—Oblon, Spivak, McClelland, Maier & Neustadt

[57] ABSTRACT

A reversible thermosensitive recording material is composed of a support, and a reversible thermosensitive recording layer formed thereon, having a reversible temperature-dependent transparency, which contains a matrix resin and an organic low-molecular-weight material. The organic low-molecular-weight material is in the form of particles, and substantially covered by the matrix resin, and the content thereof in the reversible thermosensitive recording layer is increased from the surface side thereof toward the support side. This reversible thermosensitive recording material can be prepared by a method of coating a solution or dispersion of the matrix resin and the organic low-molecular-weight material on the support, which are dissolved or dispersed in a mixed solvent composed of at least two solvents, each having a different vapor pressure, and drying the solution or dispersion.

9 Claims, 7 Drawing Sheets

SUPPORT SIDE

MAGNIFICATION x 3600

SUPPORT SIDE

MAGNIFICATION x 9600

SUPPORT SIDE

MAGNIFICATION x 14100

1 μm

REVERSIBLE THERMOSENSITIVE RECORDING MATERIAL AND METHOD OF PRODUCING THE SAME

BACKGROUND OF THE INVENTION

1. Field of the Invention

The present invention relates to a reversible thermosensitive recording material capable of recording and erasing images repeatedly by utilizing its property that the transparency can be changed reversibly from a transparent state to an opaque state, and vice versa, depending upon the temperature thereof, and a method of producing the same.

2. Discussion of Background

Recently attention is paid to a reversible thermosensitive recording material capable of temporarily recording images thereon and erasing the same therefrom when such images become unnecessary. As representative examples of that kind of reversible thermosensitive recording material, there are conventionally known reversible thermosensitive recording materials in which an organic low-molecular-weight material such as a higher fatty acid is dispersed in a matrix resin such as vinyl chloride - vinyl acetate copolymer with a glass transition temperature (Tg) of 50° C. to less than 90° C., as disclosed in Japanese Laid-Open Patent Applications 54-119377, 55-154198, 63-39376 and 63-107584.

In the case where only heat energy is applied to the reversible thermosensitive recording material by using a heat-application roller or a heat-pen, with slight application of pressure thereto, in order to perform recording and erasing operations, the durability of the recording material is not degraded even though the image formation and the erasure are repeated. In contrast to this, when heat and pressure are applied to the recording material at the same time by using a thermal head, the durability of the recording material is degraded during the repeated operations. This is because the matrix resin around the organic low-molecular-weight material particles in the recording layer is deformed and the particle size of the finely-divided organic low-molecular-weight material particles dispersed in the matrix resin is increased while the recording and erasing operations are repeated. As a result, the effect of scattering light is decreased, and the whiteness degree of a white opaque portion in the recording layer is also decreased. In the end, the image contrast is disadvantageously lowered.

When these conventional reversible thermosensitive recording materials are manufactured, an organic solvent such as tetrahydrofuran is employed as a base solvent which dissolves or disperses both the matrix resin and the organic low-molecular-weight material for the recording layer. Organic solvents of this kind have extremely low boiling points and high evaporation rates, so that such solvents are evaporated from a coating liquid applied to a support for the formation of a recording layer thereon even before the coating liquid applied is dried. As a result, a thin matrix resin layer is formed on the surface of the recording layer. Due to the formation of the thin film of the matrix resin on the surface of the recording layer, not only the evaporation of the solvent within the recording layer is prevented but also the particle diameter of the organic low-molecular-weight material dispersed in the matrix resin increases, and the organic low-molecular-weight material is separated out on the surface of the recording layer.

Moreover, there is a disadvantage that the adhesion strength cannot be maintained at the interface between the support and the thermosensitive recording layer because of the residual solvent in the thermosensitive recording layer. In addition to the above disadvantage, because of the presence of the residual solvent in the thermosensitive recording layer, there is a problem that another layer cannot be smoothly overlaid on the surface of the recording layer. In the case where image formation and the erasure are repeated many times with simultaneous application of pressure and heat to the recording material, small particles of the low-molecular-weight material are separated out on the surface thereof. When a protective layer is overlaid on the recording material, the small particles of the organic low-molecular-weight material in the recording layer migrate to the protective layer and the small particles thereof in the form of dust contact a thermal head, and adhere thereto. The result is that the image formation and the erasure cannot be repeated many times with such a conventional reversible thermosensitive recording material.

A conventional reversible thermosensitive recording material comprises the matrix resin and the organic low-molecular-weight material at a weight ratio in the range of (1:2) to (16:1). In the case where the weight ratio of the matrix resin to the low-molecular-weight material exceeds the above range, it is difficult for the recording layer to assume a white opaque state, although the durability of the recording layer may be improved. On the other hand, in the case where the ratio of the matrix resin to the low-molecular-weight material is smaller than the above range, the durability of the recording layer is degraded and the performance of forming a film in which the organic low-molecular-weight material is dispersed in the matrix resin is degraded. A satisfactory reversible thermosensitive recording material has not been obtained yet.

SUMMARY OF THE INVENTION

It is therefore a first object of the present invention to provide a reversible thermosensitive recording material free from the above-mentioned conventional defects, having improved durability, capable of yielding high image contrast, without any dust adhered to a thermal head, and with the decrease in the whiteness degree of a milky white opaque portion of the recording material being minimized when the image formation and the erasure are repeatedly performed by applying heat and pressure to the reversible thermosensitive recording material at the same time by using a thermal head.

A second object of the present invention is to provide a method of producing the above-mentioned reversible thermosensitive recording material.

The first object of the present invention can be achieved by a reversible thermosensitive recording material comprising a support and a reversible thermosensitive recording layer formed thereon, which comprises a matrix resin and an organic low-molecular-weight material dispersed in the matrix resin. The organic low-molecular-weight material is in the form of particles and substantially covered with the matrix resin, and the content thereof is increased from the surface of the thermosensitive recording layer toward the support.

The second object of the present invention can be achieved by coating a solution or dispersion of the matrix resin and the organic low-molecular-weight material on the support, which are dissolved or dispersed in a mixed solvent comprising at least two solvents, each having a different vapor pressure, and drying the solution or dispersion, and when necessary, by heating the support to a predetermined temperature prior to the step of coating the solution or dispersion on the support.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
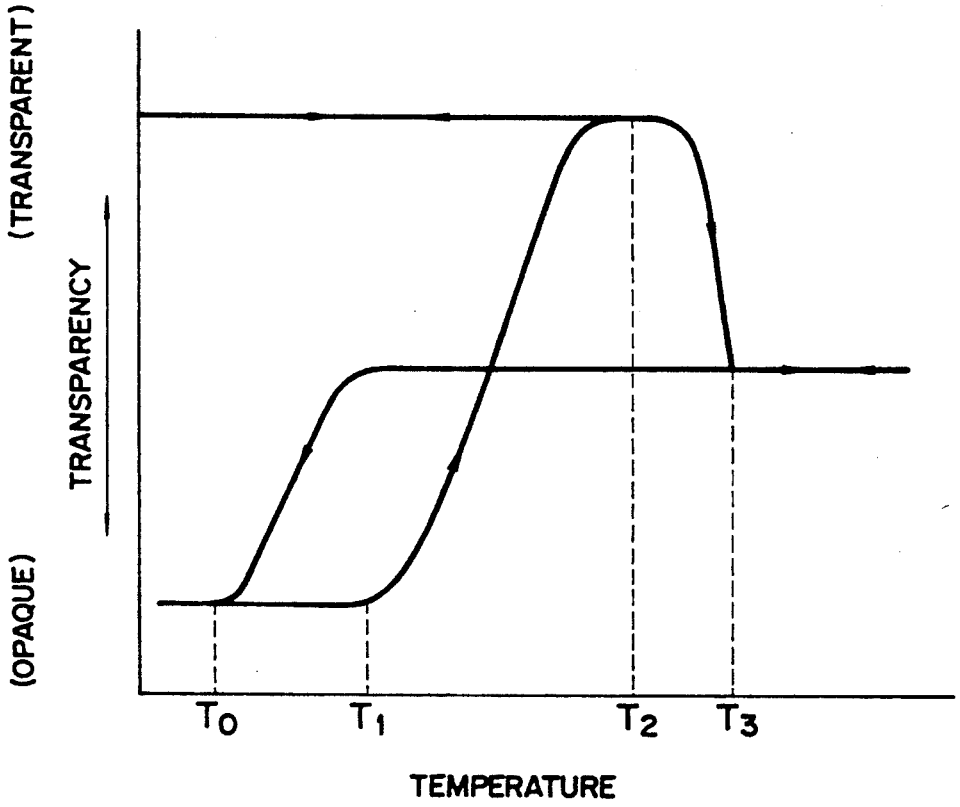
FIG. 1 is a diagram in explanation of the principle of formation and erasure of images in a reversible thermosensitive recording material of the present invention.
Figure 2:
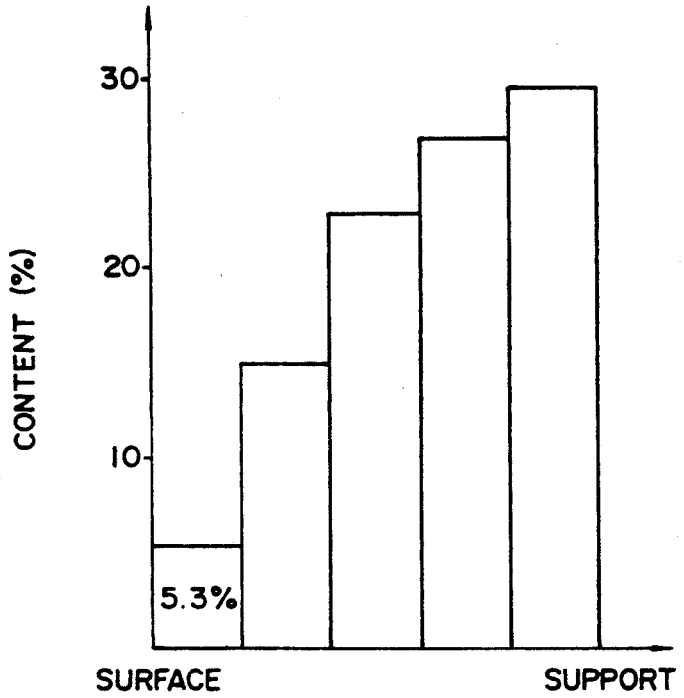
FIG. 2 is a graph which shows the content of the organic low-molecular-weight material in the reversible thermosensitive recording material prepared in Example 1.
Figure 3:
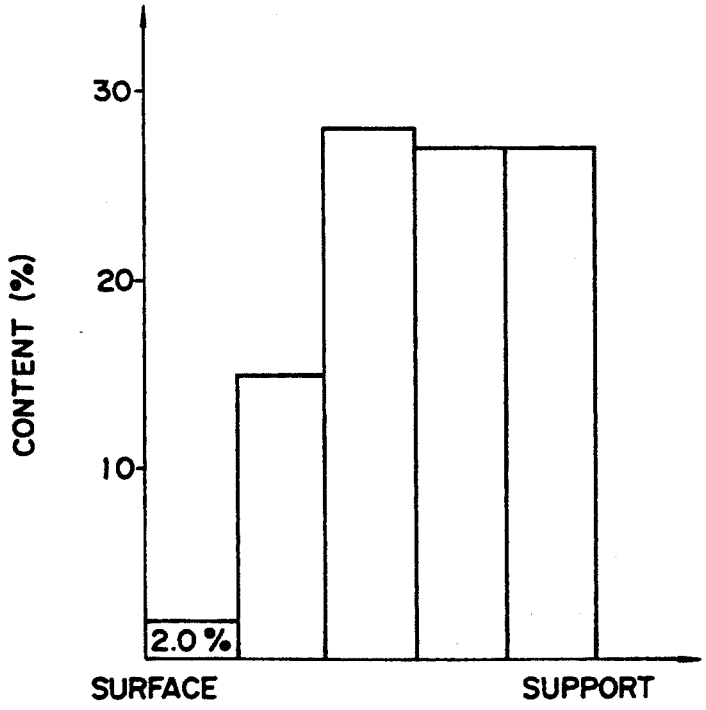
FIG. 3 is a graph which shows the content of the organic low-molecular-weight material in the reversible thermosensitive recording material prepared in Example 2.
Figure 4:
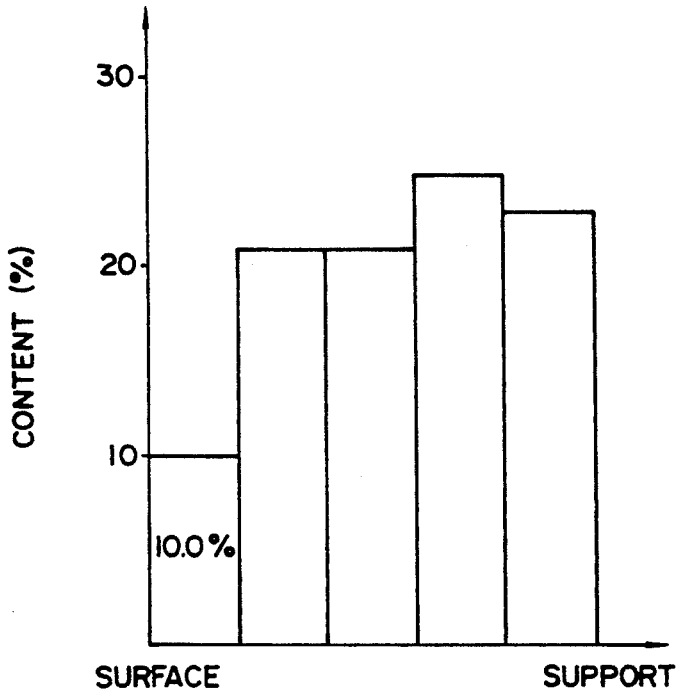
FIG. 4 is a graph which shows the content of the organic low-molecular-weight material in the reversible thermosensitive recording material prepared in Example 3.
Figure 5:
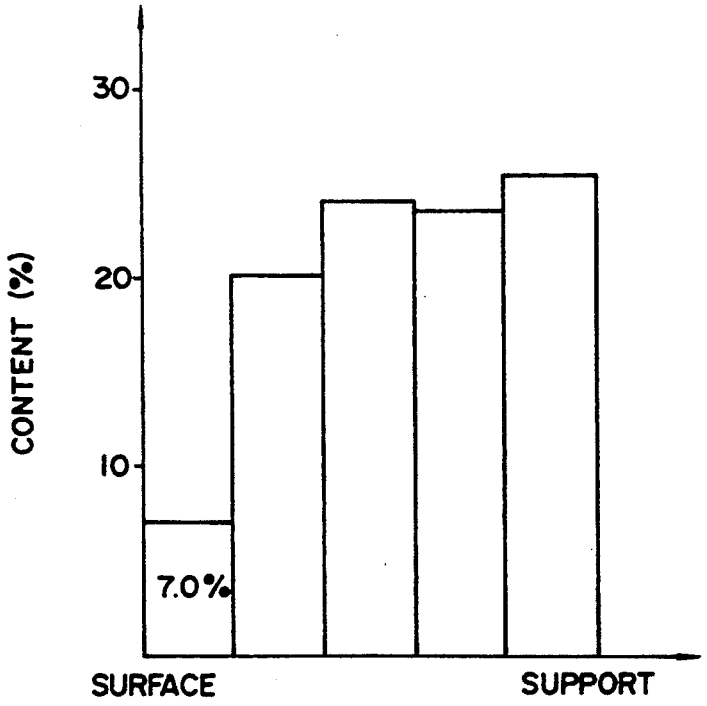
FIG. 5 is a graph which shows the content of the organic low-molecular-weight material in the reversible thermosensitive recording material prepared in Example 4.
Figure 6:
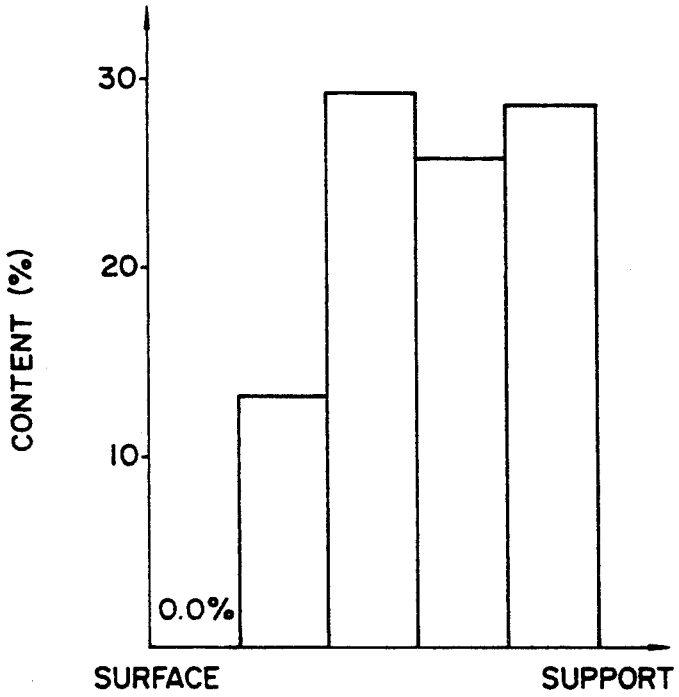
FIG. 6 is a graph which shows the content of the organic low-molecular-weight material in the reversible thermosensitive recording material prepared in Example 6.
Figure 7:
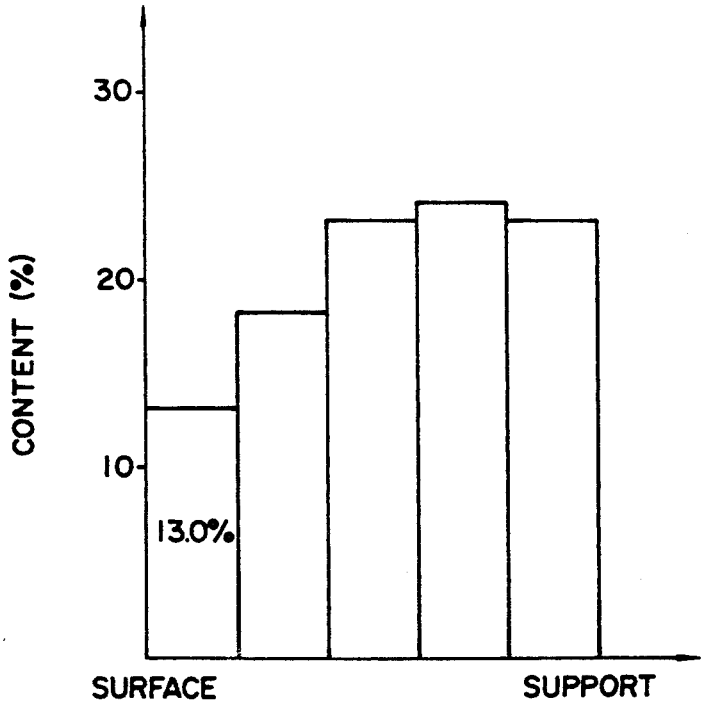
FIG. 7 is a graph which shows the content of the organic low-molecular-weight material in the reversible thermosensitive recording material prepared in Comparative Example.

The reversible thermosensitive recording material of the present invention comprises a support, and a reversible thermosensitive recording layer formed thereon, having a reversible temperature-dependent transparency, which comprises a matrix resin and an organic low-molecular-weight martial. The organic low-molecular-weight material is in the form of small particles dispersed therein, and substantially covered with the matrix resin, and the content of the organic low-molecular-weight material in the thermosensitive recording layer increases from the surface thereof toward the support.

Since the inner portion of the thermosensitive recording layer is not substantially affected by the heat and pressure of a thermal head, the matrix resin around the small particles of organic low-molecular-weight material are hardly deformed and the small particles of the organic low-molecular-weight material do not easily become large particles. Thus, the initial image-formation performance can be maintained even when the image formation and the erasure are repeatedly performed.

On the other hand, the surface portion of the thermosensitive recording layer is significantly affected by the heat and pressure of a thermal head. However, since the content of the organic low-molecular-weight material is small and the organic low-molecular-weight material is thickly covered with the matrix resin, the organic low-molecular-weight material dispersed in the matrix resin can be maintained in the form of finely-divided particles. Therefore, the image contrast is hardly degraded in the course of the repeated image formation and erasure using a thermal head.

Furthermore, the small particles of the organic low-molecular-weight material on the surface of the thermosensitive layer are substantially covered with the matrix resin, so that the migration does not occur. Therefore, no dust adheres to a thermal head even though the recording and erasing operations are repeated by use of a thermal head, so that uniform image formation can be attained.

In the thermosensitive recording layer for use in the present invention, it is preferable that the organic low-molecular-weight material be contained in the region of 4/5 of the entire thickness of the thermosensitive recording layer measured from the support side in an amount of 88.0% or more, more preferably 90.0% or more, of the entire content of the thermosensitive recording layer, because when in that case, the surface of the thermosensitive recording layer is hardly deformed by the heat and pressure of a thermal head.

The content of the organic low-molecular-weight material is calculated by the percentage of the total cross-sectional area of the organic low-molecular-weight material on the basis of the entire cross section of the thermosensitive recording layer, which is observed from a transmission-type electron microscope photograph of the cross section.

In the thermosensitive recording layer in which the organic low-molecular-weight material is substantially covered with the matrix resin, it is preferable that the organic low-molecular-weight material be present only in the region of 29/30 of the entire thickness of the thermosensitive recording layer measured from the support side, because in this case, the organic low-molecular-weight material does not exist on the surface of the thermosensitive recording layer, and the migration does not occur, so that no dust adheres to the thermal head.

Light which enters the thermosensitive recording layer in which the organic low-molecular-weight material is dispersed is scattered by the organic low-molecular-weight material or passes therethrough. This is considered to occur depending upon the crystalline state of the organic low-molecular-weight material, that is, the changes from a single crystalline state to a polycrystalline state, and vice versa, as will be described in detail later. It is considered that there is an interaction between the organic low-molecular-weight material and the matrix resin. The degree of the interaction differs depending on the particle size of the organic low-molecular-weight material, causing changes in the degree of the transparency of the thermosensitive recording layer, that is, the changes from a transparent state to a white opaque state, and vice versa. becomes different.

When the particle diameter of the organic low-molecular-weight material which is dispersed in the thermosensitive recording layer exceeds 5.0 μm, it is difficult for the organic low-molecular-weight material to assume a polycrystalline state, so that the effect of scattering light is reduced, the whiteness degree is lowered, and accordingly the image contrast is decreased. On the other hand, when the particle diameter of the organic low-molecular-weight material which is dispersed in the thermosensitive recording layer is less than 0.05 μm, it is difficult for the organic low-molecular-weight material to assume a polycrystalline state in the matrix resin. It is considered that in this case, the image contrast is lowered because the whiteness degree of the thermosensitive material is degraded. It is preferable that the average particle diameter of the organic low-molecular-weight material be in the range of 0.05 to 5.0 μm, more preferably in the range of 0.1 to 1.0 μm, in order to obtain high contrast.

Further, when the content of the organic low-molecular-weight material in the thermosensitive recording layer is increased toward the support side, at least two thermosensitive recording layers, each comprising a different amount of the organic low-molecular-weight material, can be overlaid.

When the image formation and the erasure are performed, the heat distribution on the surface of the uppermost thermosensitive recording layer differs from that of the lower thermosensitive recording layers near the support. Therefore, when two or more thermosensitive recording layers are overlaid, it is preferable that the thermosensitive recording layer near the surface of the recording material have a higher transparency temperature at which the thermosensitive recording layer becomes transparent, and the lower thermosensitive recording layers near the support a lower transparency temperature. The temperature at which the thermosensitive recording layer near the support assumes a transparent state is preferably in the range of 50° to 100° C., and the temperature at which the thermosensitive recording layer near the surface assumes a transparent state is preferably in the rang of 70° to 120° C. It is preferable that the transparency temperature span in which each thermosensitive recording layer maintains to assume a transparent state be 10° to 50° C. This transparency temperature span can be set within the above span in accordance with application and the objects.

Furthermore, it is preferable that the average particle diameter of the organic low-molecular-weight material be increased from the surface of the thermosensitive recording layer toward the support side As previously mentioned, the content of the organic low-molecular-weight material is calculated by the percentage of the total cross-sectional area of the organic low-molecular-weight material on the basis of the entire cross section of the thermosensitive recording layer, which is observed from a transmission-type electron microscope photograph of the cross section. The observation is performed by use of a transmission-type electron microscope ("H-500H" made by Hitachi, Ltd.) under the following conditions:

| | |
|---|---|
| Accelerating voltage: | 75 kV |
| Sampling: | Ultra-slicing method with osumium treatment |

That the content of the organic low-molecular-weight material increases toward the support side means that the above defined total cross-sectional area increases from the surface of the thermosensitive recording layer toward the support side.

As mentioned previously, it is preferable that the total cross-sectional area of the organic low-molecular-weight material be 88% or more, more preferably 90% or more, in the region of 4/5 of the entire thickness of the thermosensitive recording layer measured from the support. Therefore, when no organic low-molecular-weight material is observed by the above-mentioned observation method, it is considered that no organic low-molecular-weight material exists in the observed portion of the thermosensitive recording layer.

The particle diameter of the organic low-molecular-weight material in the thermosensitive recording layer is defined by the diameter of a circle which is considered to correspond to the cross section of the organic low-molecular-weight material in the thermosensitive recording layer, observed in the transmission-type electron microscope photograph of the cross section of the thermosensitive recording layer which is taken under the same conditions as in the case of the observation of the content of the organic low-molecular-weight material.

As mentioned previously, it is preferable that the average particle diameter of the organic low-molecular-weight material be increased from the surface of the thermosensitive recording layer toward the support side.

More specifically, it is preferable that the particle diameter of the organic low-molecular-weight material has such a gradient that when the thermosensitive recording layer is divided into five portions in the direction of the thickness of the thermosensitive recording layer, that is, in the direction parallel to the top surface of the thermosensitive recording layer, the average diameter of the organic low-molecular-weight material which exists in the 1/5 region of the entire thickness of the thermosensitive recording layer on the support side is larger than the average diameter thereof which exists within the 1/5 region of the thickness on the thermosensitive recording layer surface side.

It is preferable that the thickness of the thermosensitive recording layer be in the range of 1 to 30 μm, and more preferably in the range of 2 to 20 μm. When the thickness of the thermosensitive recording layer is within the above range, the particles of the organic low-molecular-weight material are not easily deformed, and even when the image formation and the erasure are repeated many times, the image contrast is not degraded. Moreover, the quality of the reversible thermosensitive recording material can be maintained since high energy is not required for the image formation and the erasure.

The reversible thermosensitive recording material of the present invention ca be switched from a transparent state to a milky white opaque state, and vise versa, depending on the temperature thereof. It is presumed that the difference between the transparent state and the milky white opaque state of the recording material is based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axes pointed to various directions, so that the light which enters the recording layer is scattered a number of times on the interface of crystals of the low-molecular-weight material. As a result, the thermosensitive recording layer becomes opaque in a milky white color.

The transition of the state of the reversible thermosensitive recording layer depending on the temperature thereof will now be explained by referring to FIG. 1.

In FIG. 1, it is supposed that the reversible thermosensitive recording material comprising a matrix resin and a low-molecular-weight material dispersed in the matrix resin is initially in a milky white opaque state at room temperature $T_0$ or below. When the recording material is heated to temperature $T_2$, the recording material becomes transparent. Thus, the recording material reaches a maximum transparent state at temperature $T_2$. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to temperature $T_3$ or more, it assumes a medium state which is between the maximum transparent state and the maximum milky white opaque state. When the recording material in the medium state at temperature $T_3$ is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording material in the milky white opaque state is heated to any temperature between temperature $T_1$ and temperature $T_2$, and then cooled to a temperature below the room temperature $T_0$, the recording material assumes an intermediate state between the transparent state and the milky white opaque state.

When the recording material in the transparent state at room temperature $T_0$ is again heated to temperature $T_3$ or above, and then cooled to room temperature $T_0$, the recording material returns to the milky white opaque state. Thus, the reversible thermosensitive recording material according to the present invention can assume a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording material according to the present invention. Further, such image formation and erasure can be repeated many times.

When a colored sheet is placed behind the reversible thermosensitive recording layer of the recording material, the colored image can be obtained on the white opaque background or the white opaque image can be obtained on the colored background.

In the case where the reversible thermosensitive recording material of the present invention is projected using an OHP (Over Head Projector), a milky white opaque portion in the recording material appears dark and a transparent portion in the recording material, through which the light passes becomes a bright portion on the screen.

To form the reversible thermosensitive recording layer on the support, (1) a solution in which both the matrix resin and the organic low-molecular-weight material are dissolved, or (2) a dispersion prepared by dispersing the finely-divided particles of the organic low-molecular-weight material in a matrix resin solution may be coated on the support such as a plastic film or a glass plate, then dried, so that the reversible thermosensitive recording layer can be formed on the support. The aforementioned matrix resin dispersion of the low-molecular-weight material (2) employs a solvent in which at least one of the low-molecular-weight materials can not be dissolved.

In order to obtain the reversible thermosensitive recording layer in which the content of the organic low-molecular-weight material is increased toward the support side, various methods can be employed, for instance, a method of utilizing a particular mixed solvent or adopting particular preparation conditions.

In a method utilizing a particular mixed solvent, for instance, two kinds of organic solvents having different vapor pressures are employed when preparing a solution or dispersion of a matrix resin and the organic low-molecular-weight material for the formation of the thermosensitive recording layer on a support by drying the coated solution or dispersion.

In this case, the evaporation rate and the diffusion rate of the solution or dispersion are appropriately adjusted because of at least two constituent organic solvents with different vapor pressures during the coating and drying processes. Therefore, no thin film of the thermosensitive recording layer is formed prior to the drying of the thermosensitive recording layer in the course of the coating and drying processes, so that the organic low-molecular-weight material can be uniformly dispersed in the resin matrix in the course of the evaporation of the solvent in the drying process. As a result, the growth of the particle diameter of the organic low-molecular-weight material is appropriately controlled.

Furthermore, in the thermosensitive recording layer prepared by the above method, the organic low-molecular-weight material does not exist near the surface of the thermosensitive recording layer, but the particle size of the organic low-molecular-weight material is very small and the content of the organic low-molecular-weight material is uniformly increased from the surface side of the thermosensitive recording layer to the support side.

It is preferable that in the present invention, tetrahydrofuran be employed as a basic solvent, and that a mixed solvent of tetrahydrofuran and a solvent which can be appropriately mixed with tetrahydrofuran and have a lower vapor pressure than that of tetrahydrofuran be employed.

The previously mentioned effects can be obtained when the content of the solvent to be added to the basic solvent is in the range of 5 to 50 vol. %, preferably in the range of 10 to 30 vol. %.

When heat is applied to the support before coating the thermosensitive recording layer, for example, by incorporating an apparatus such as a heater roll or a heater panel, and the coating of the thermosensitive recording layer is conducted while heating the support, the evaporation rate and the diffusion rate of the solvents in the course of the coating and drying processes are appropriately adjusted, so that a thin film of the thermosensitive recording layer is no formed and immediately after the coating, the matrix resin in the thermosensitive recording layer is cured, and the growth of the particle diameter of the organic low-molecular-weight material is appropriately controlled. The result is that the organic low-molecular-weight material with an extremely small diameter are uniformly dispersed the support.

It is preferable that the heating temperature of the support be in the range of 50° to 120° C. in order to obtain the above-mentioned effects, more preferably in the range of 70° to 100° C.

The solvent used for the formation of the thermosensitive recording layer can be selected depending on the kind of the matrix resin and the type of the organic low-molecular-weight material to be employed. For example, the solvents such as tetrahydrofuran, methyl ethyl ketone, methyl isobutyl ketone, chloroform, carbon tetrachloride, ethanol, toluene and benzene can be employed. Not only when a matrix resin dispersion is used, but also when a matrix resin solution is used, the organic low-molecular-weight material is separated in the form of finely-divided particles in the matrix resin of the thermosensitive recording layer.

The matrix resin for use in the present invention is a material to form a thermosensitive recording layer in which the particles of the organic low-molecular-weight material are uniformly dispersed, and has effects on the transparency when the thermosensitive recording layer is in a maximum transparent state.

Therefore, as such a matrix resin, resins which impart high transparency, mechanical stability and excellent film-forming properties to the thermosensitive recording layer are preferably employed.

Examples of the resin with such properties include polyvinyl chloride; vinyl chloride copolymers such as vinyl chloride—vinyl acetate copolymer, vinyl chloride—vinyl acetate—vinyl alcohol copolymer, vinyl chloride—vinyl acetate—malec acid copolymer and vinyl chloride—acrylate copolymer; vinylidene chloride copolymers such as polyvinylidene chloride, vinylidene chloride—vinyl chloride copolymer and vinylidene chloride—acrylonitrile copolymer; polyester; polyamide; polyacrylate, polylmethacrylate or acrylate—methacrylate copolymer; and a silicone resin. These resins can be used alone or in combination.

The organic low-molecular-weight material for use in the reversible thermosensitive recording layer may be appropriately selected from the materials which are changeable from the polycrystalline state to the single crystalline state in accordance with each of the desired temperatures ranging from $T_0$ to $T_3$ as shown in FIG. 1.

It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids; and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O— and a halogen atom.

Specific example of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid and oleic acid; higher fatty acids having a high-boiling point of about 80° to 150° C. such as lignoceric acid, cerotic acid, montanic acid, melissic acid, eicosanedioic acid, pentatriacontanoic acid, hexatriacontanoic acid, heptatriacontanoic acid, octatriacontanoic acid, hexatetracontanoic acid; esters of higher fatty acids such as methyl stearate, tetradecyl stearate, octadecyl stearate, octadecyl laurate, tetradecyl palmitate and dodecyl behenate; and the following ethers or thioethers:

$C_{16}H_{33}—O—C_{16}H_{33}$, $C_{16}H_{33}—S—C_{16}H_{33}$, $C_{18}H_{37}—S—C_{18}H_{37}$, $C_{12}H_{25}—S—C_{12}H_{25}$, $C_{19}H_{39}—S—C_{19}H_{39}$, $C_{12}H_{25}—S—S—C_{12}H_{25}$,

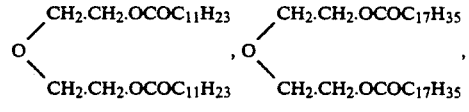

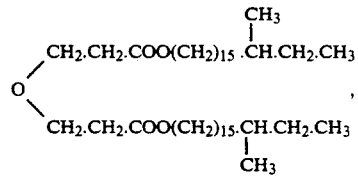

-continued

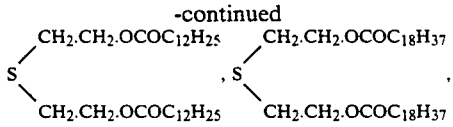

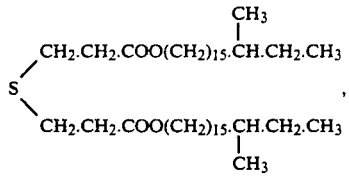

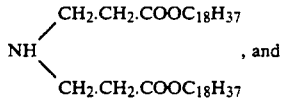

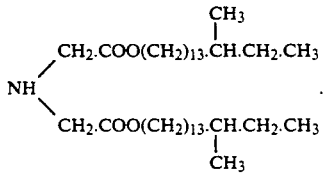

Of these, higher fatty acids having 16 or more carbon atoms more preferably having 16 to 24 carbon atoms, such as palmitic acid, stearic acid, behenic acid and lignoceric acid are preferred in the present invention.

To widen the range of the temperature where the recording material can assume a transparent state, it is preferable to use the aforementioned organic low-molecular-weight materials in combination, or use the organic low-molecular-weight material in combination with the other material having a different melting point. Such materials having a different melting point are disclosed, for example, in Japanese Laid-Open Patent Applications 63-39378 and 63-130380.

It is preferable that the ratio by weight of the organic low-molecular-weight material to the matrix resin be in the range of about (2:1) to (1:16), more preferably in the range of (1:1) to (1:5) in the reversible thermosensitive recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

In the reversible thermosensitive recording layer for use in the present invention, additives such as a surface-active agent and a high-boiling point solvent can be employed to facilitate the formation of a transparent image.

Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; long-chain alkyl methacrylate amine-containing monomer copolymer; styrene - maleic anhydride copolymer; and olefin - maleic anhydride copolymer.

In the present invention, when the image formed on the reversible thermosensitive recording material is observed as a reflection type image, a light reflection layer may be formed behind the recording layer to improve the contrast of the image even if the thickness of the recording layer is made thin. Specifically, the light reflection layer can be prepared by deposition of aluminum, nickel and tin on the support.

Further, a protective layer can be formed on the reversible thermosensitive recording layer in order to protect the thermosensitive recording layer. As the material for the protective layer with a thickness of 0.1 to 5 μm, a silicone rubber, a silicone resin, a polysiloxane graft polymer, an ultraviolet-curing resin or an electron radiation curing resin can be employed. In any case, the material for the protective layer is dissolved in a solvent to prepare a coating liquid and the thus prepared coating liquid is coated on the thermosensitive recording layer. It is desirable that the resin and the organic low-molecular-weight material for us in the thermosensitive recording layer be not easily dissolved in such a solvent for use in the protective layer.

Examples of the above-mentioned solvent in which the resin and the organic low-molecular-weight material for use in the thermosensitive recording layer are not easily dissolved include n-hexane, methyl alcohol, ethyl alcohol and isopropyl alcohol. In particular, the alcohol-based solvents are preferred from the viewpoint of the cost.

Further, an intermediate layer with a thickness of 0.1 to 2.0 μm can be interposed between the protective layer and the thermosensitive recording layer to protect the thermosensitive recording layer from a solvent or a monomer component for the protective layer formation liquid.

Examples of the resin for use in the formation of the intermediate layer include polyethylene, polypropylene, polystyrene, polyvinyl alcohol, polyvinyl butyral, polyurethane, saturated polyester, unsaturated polyester, epoxy resin, phenolic resin, polycarbonate and polyamide.

In the present invention, a thermosensitive recording layer with a high stability can be obtained even heat and pressure are applied thereto using a thermal head. When the image formation and erasure is not repeated many times, in particular, a thermal head can be pressed to the recording material with high pressure. Then the adherence between the thermal head and the recording material is improved and the thermosensitivity can be upgraded.

Other features of this invention will become apparent in the course of the following description of exemplary embodiments which are given for illustration of the invention and are not intended to be limiting thereof.

EXAMPLE 1

[Formation of Light Reflection Layer]

An aluminum-deposited layer with a thickness of about 400 Å serving as a light reflection layer was formed on a polyester film with a thickness of about 50 μm.

[Formation of Reversible Thermosensitive Recording Layer]

The following components were mixed to prepare a coating liquid for the formation of a reversible thermosensitive recording layer:

| | Parts by Weight |
|---|---|
| Stearic acid | 6 |
| Eicosanedioic acid | 4 |
| Diisodecyl phthalate | 3 |
| Vinyl chloride-vinyl acetate-phosphoric ester copolymer (Trademark "Denka Vinyl #1000P" made by Denki Kagaku Kogyo K.K.) | 27 |
| Tetrahydrofuran | 128 |
| Toluene | 32 |

The thus obtained coating liquid was coated on the above formed light reflection layer by a wire bar and dried, with a drying temperature of 100° C. and a drying time of 60 sec., so that a reversible thermosensitive recording layer having a thickness of about 15 μm was formed on the light reflection layer.

[Formation of Intermediate Layer]

The following components were mixed to prepare a coating liquid for the formation of an intermediate layer:

| | Parts by Weight |
|---|---|
| Polyamide resin (Trademark "CM8000" made by Toray Industries, Inc.) | 10 |
| Ethyl alcohol | 90 |

The thus obtained coating liquid was coated on the above formed reversible thermosensitive recording layer by a wire bar and dried under application of heat thereto with a drying temperature of 80° C. and a drying time of 10 sec., so that an intermediate layer with a thickness of about 0.5 μm was formed on the reversible thermosensitive recording layer.

[Formation of Protective Layer]

The following components were mixed to prepare a coating liquid for the formation of a protective layer:

| | Parts by Weight |
|---|---|
| 75% butyl acetate solution of urethane-acrylate ultraviolet-curing resin (Trademark "Unidic C7-157" made by Dainippon Ink & Chemicals, Incorporated) | 10 |
| Toluene | 10 |

The thus obtained coating liquid was coated on the above formed intermediate layer by a wire bar, dried under application of heat thereto, with a drying temperature of 100° C. and a drying time of 10 sec. and cured using an ultraviolet lamp of 80 W/cm, so that a protective layer with a thickness of about 2 μm was formed.

Thus, a reversible thermosensitive recording material No. 1 according to the present invention was obtained.

EXAMPLE 2

[Formation of Reversible Thermosensitive Recording Layer]

The following components were mixed to prepare a coating liquid for the formation of a reversible thermosensitive recording layer:

| | Parts by Weight |
|---|---|
| Behenic acid | 7 |
| Eicosanedioic acid | 3 |
| Vinyl chloride-vinyl acetate copolymer (Trademark "VYHH" made by Union Carbide Japan K.K.) | 28 |
| Di-2-ethylhexyl phthalate | 3 |
| Tetrahydrofuran | 128 |
| 2-propanol | 22 |

The above prepared coating liquid was coated on a transparent polyester film having a thickness of about 50 μm serving as a support, by a wire bar and dried, with a drying temperature of 100° C. and a drying time of 2 min., so that a reversible thermosensitive recording layer with a thickness of 4 μm was formed on the support.

[Formation of Intermediate Layer]

The following components were mixed to prepare a coating liquid for the formation of an intermediate layer:

| | Parts by Weight |
|---|---|
| Polyamide resin (Trademark "CM8000" made by Toray Industries, Inc.) | 10 |
| Ethyl alcohol | 90 |

The thus obtained coating liquid was coated on the above formed reversible thermosensitive recording layer by a wire bar and dried under application of heat thereto, with a drying temperature of 80° C. and a drying time of 60 sec., so that an intermediate layer having a thickness of about 0.5 μm was formed on the reversible thermosensitive recording layer.

[Formation of Protective Layer]

The following components were mixed to prepare a coating liquid for the formation of an intermediate layer:

| | Parts by Weight |
|---|---|
| 75% butyl acetate solution of urethane-acrylate ultraviolet-curing resin (Trademark "Unidic C7-157" made by Dainippon Ink & Chemicals, Incorporated) | 10 |
| Toluene | 10 |

The above coating liquid was coated on the above formed intermediate layer by a wire bar, dried under application of heat thereto and hardened by using an ultraviolet lamp of 80 W/cm, so that a protective layer having a thickness of 2 μm was formed on the intermediate layer.

Thus, a reversible thermosensitive recording material No. 2 according to the present invention was obtained.

EXAMPLE 3

The procedure for preparation of the reversible thermosensitive recording material No. 1 in Example 1 was repeated except that the formulation of the reversible thermosensitive recording layer in Example 1 was changed to the following formulation, and heat was applied to the support to 80° C. by a heater roll before coating the coating liquid for the thermosensitive recording layer, whereby a reversible thermosensitive recording layer with a thickness of 4 μm was formed on an about 400 Å thick aluminum-layer deposited polyester film with a thickness of about 50 μm:

[Formulation of Reversible Thermosensitive Recording Layer]

| | Parts by Weight |
|---|---|
| Stearic acid | 6 |
| Eicosanedioic acid | 4 |
| Diisodecyl phthalate | 3 |
| Vinyl chloride-vinyl acetate-phosphoric ester copolymer (Trademark "Denka Vinyl #1000P" made by Denki Kagaku Kogyo K.K., Tg: 78° C.) | 27 |
| Tetrahydrofuran | 128 |

Thus, a reversible thermosensitive recording material No. 3 according to the present invention was obtained.

EXAMPLE 4

[Formation of Light Reflection Layer]

An aluminum-deposited layer with a thickness of about 400 Å serving as a light reflection layer was formed on a polyester film with a thickness of about 50 μm.

[Formation of First Reversible Thermosensitive Recording Layer]

The following components were mixed to prepare a coating liquid for the formation of a first reversible thermosensitive recording layer:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P" made by Denki Kagaku Kogyo K.K.) | 20 |
| Tetrahydrofuran | 150 |
| Toluene | 15 |

The thus obtained coating liquid was coated on the above formed light reflection layer by a wire bar and dried under application of heat thereto, so that a first reversible thermosensitive recording layer having a thickness of about 2 μm was formed on the light reflection layer.

[Formation of Second Reversible Thermosensitive Recording Layer]

The following components were mixed to prepare a coating liquid for the formation of a second reversible thermosensitive recording layer:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P" made by Denki Kagaku Kogyo K.K.) | 60 |
| Tetrahydrofuran | 400 |
| Toluene | 50 |

The thus obtained coating liquid was coated on the above formed first reversible thermosensitive recording layer by a wire bar and dried under application of heat thereto, so that a second reversible thermosensitive recording layer having a thickness of about 2 μm was formed on the first reversible thermosensitive recording layer.

[Formation of Intermediate Layer]

The following components were mixed to prepare a coating liquid for the formation of an intermediate layer:

| | Parts by Weight |
|---|---|
| Polyamide resin (Trademark "CM8000" made by Toray Industries, Inc.) | 10 |
| Ethyl alcohol | 90 |

The thus obtained coating liquid was coated on the above formed second reversible thermosensitive recording layer by a wire bar and dried under application of heat thereto, so that an intermediate layer with a thickness of about 0.5 μm was formed on the second reversible thermosensitive recording layer.

[Formation of Protective Layer]

The following components were mixed to prepare a coating liquid for the formation of a protective layer:

| | Parts by Weight |
|---|---|
| 75% butyl acetate solution of urethane- | 10 |

-continued

| | Parts by Weight |
|---|---|
| acrylate ultraviolet-curing resin (Trademark "Unidic C7-157" made by Dainippon Ink & Chemicals, Incorporated) | |
| Toluene | 10 |

The thus obtained coating liquid was coated on the above formed intermediate layer by a wire bar, dried under application of heat thereto and cured using an ultraviolet lamp of 80 W/cm, so that a protective layer with a thickness of about 2 μm was formed.

Thus, a reversible thermosensitive recording material No. 4 according to the present invention was obtained.

EXAMPLE 5

The procedure for preparation of the reversible thermosensitive recording material No. 1 in Example 1 was repeated except that the stearic acid employed in the formulation of the reversible thermosensitive recording layer was replaced by behenic acid, whereby a reversible thermosensitive recording material No. 5 according to the present invention was obtained.

EXAMPLE 6

The procedure for preparation of the reversible thermosensitive recording material No. 1 in Example 1 was repeated except that heat was applied to the support to 80° C. by a heater roll before coating the coating liquid for the reversible thermosensitive recording layer, whereby a reversible thermosensitive recording layer with a thickness of about 4 μm was formed on an about 400 Å thick aluminum-layer deposited polyester film with a thickness of about 50 μm.

Thus, a reversible thermosensitive recording material No. 6 according to the present invention was obtained.

EXAMPLE 7

The procedure for preparation of the reversible thermosensitive recording material No. 4 in Example 4 was repeated except that the formulation of the second reversible thermosensitive recording layer used in Example 4 was changed to the following formulation, whereby a reversible thermosensitive recording material No. 7 according to the present invention was obtained.

| | Parts by Weight |
|---|---|
| Behenic acid | 3 |
| Eicosanedioic acid | 7 |
| Diisodecyl phthalate | 2 |
| Vinyl chloride-vinyl acetate-phosphoric ester copolymer (Trademark "Denka Vinyl #1000P" made by Denki Kagaku Kogyo K.K.) | 60 |
| Tetrahydrofuran | 400 |
| Toluene | 50 |

COMPARATIVE EXAMPLE

The procedure for preparation of the reversible thermosensitive recording material No. 1 in Example 1 was repeated except that the toluene in the formulation of the coating liquid for the formation of the reversible thermosensitive recording layer in Example 1 was eliminated, whereby a comparative reversible thermosensitive recording material was obtained.

The cross-sectional views of the above obtained reversible thermosensitive recording materials No. 1 to No. 7 in Examples 1 to 7 according to the present invention and the comparative reversible thermosensitive recording material in Comparative Example were observed by using Transmission-type Electron Microscopic (TEM) photographs. The results show that in the reversible thermosensitive recording layers for use in the present invention in Examples 1 to 7, the particles of the organic low-molecular-weight material are covered with the matrix resin. Moreover, the content of the organic low-molecular-weight material was smaller on the surface side of each thermosensitive recording layer than on the support side thereof. On the other hand, in the reversible thermosensitive recording layer in Comparative Example, the content of the organic low-molecular-weight material on the surface side of the thermosensitive recording layer was large without a content gradient toward the support.

As mentioned previously, in the present invention, it is preferable that the particle diameter of the organic low-molecular-weight material has such a gradient that when the thermosensitive recording layer is divided into five portions in the direction of the thickness of the thermosensitive recording layer, that is, in the direction parallel to the top surface of the thermosensitive recording layer, the average diameter of the organic low-molecular-weight material which exists in the 1/5 region of the entire thickness of the thermosensitive recording layer on the support side is larger than the average diameter thereof which exists within the 1/5 region of the thickness on the thermosensitive recording layer surface side.

FIG. 2 to FIG. 7 are the bar graphs showing the distribution of the organic low-molecular-weight material in the five divided portions in each of the reversible thermosensitive recording layers in Examples 1 to 6 and Comparative Example, respectively.

The average diameter of the organic low-molecular-weight material in the form of particles, the average diameter thereof near the surface of the thermosensitive recording layer, and the average diameter thereof near the support are shown in Table 1.

Figure 8:
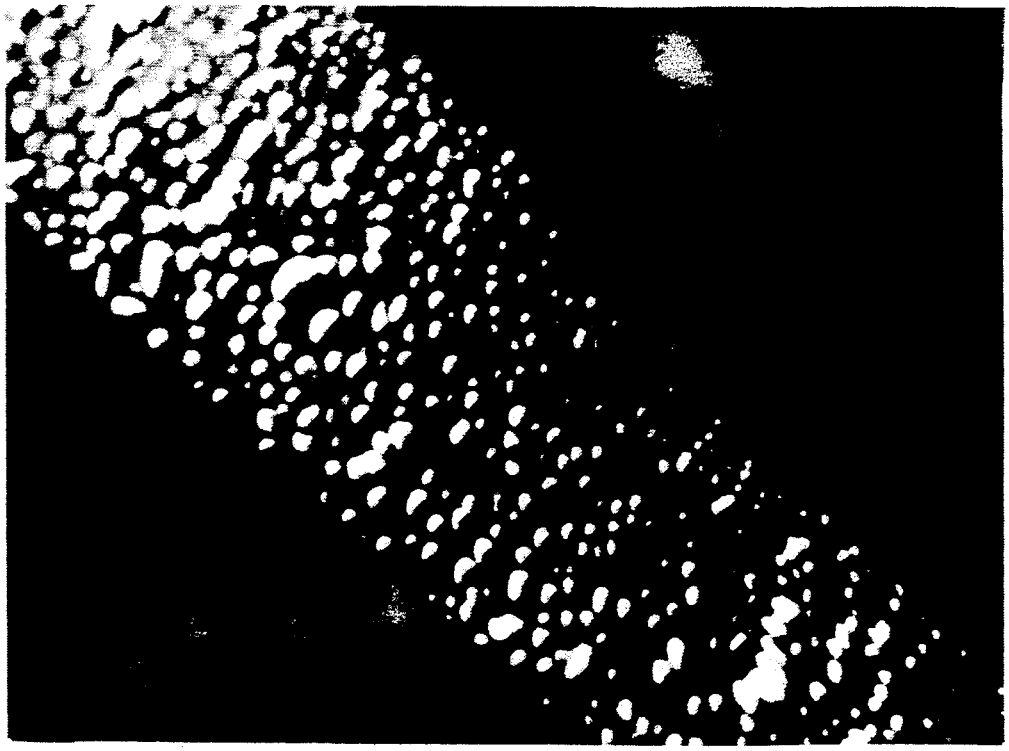
FIG. 8 is a transmission-type electron microscope (TEM) photograph of a cross section of the reversible thermosensitive recording material prepared in Example 1.

FIG. 8 is a transmission-type electron microscope (TEM) photograph of a cross section of the reversible thermosensitive recording material prepared in Example 1.

Figure 9:
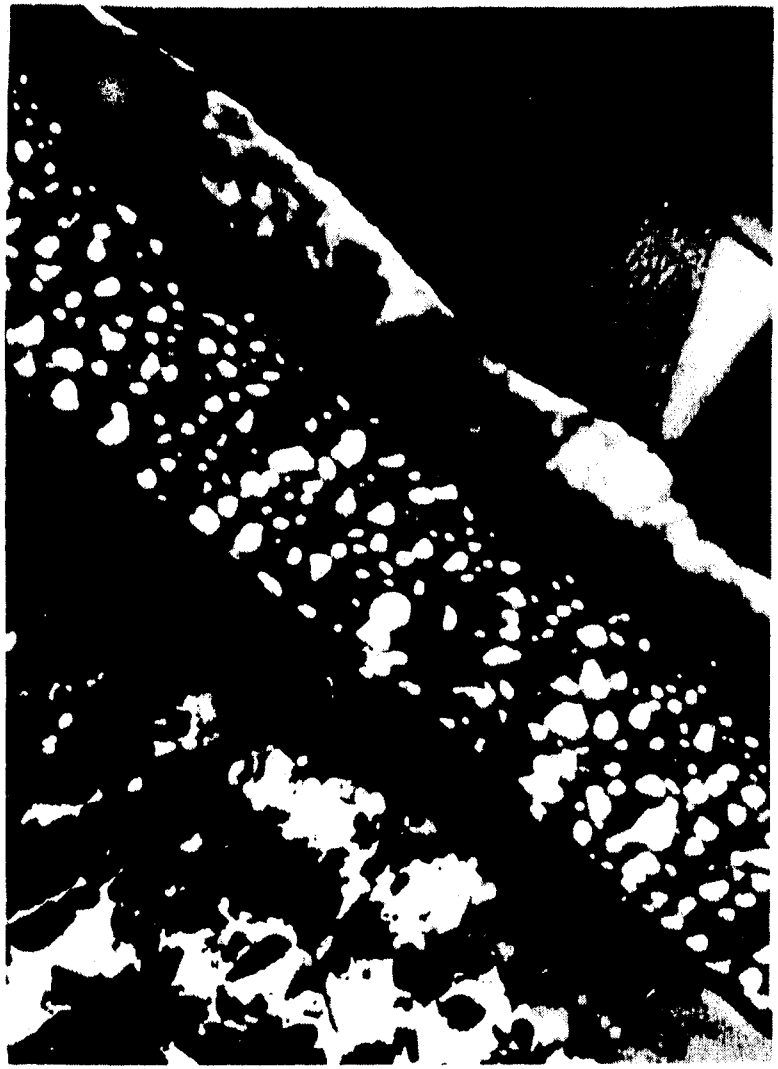
FIG. 9 is a TEM photograph of a cross section of the reversible thermosensitive recording material prepared in Example 6.

FIG. 9 is a TEM photograph of a cross section of the reversible thermosensitive recording material prepared in Example 6.

Figure 10:
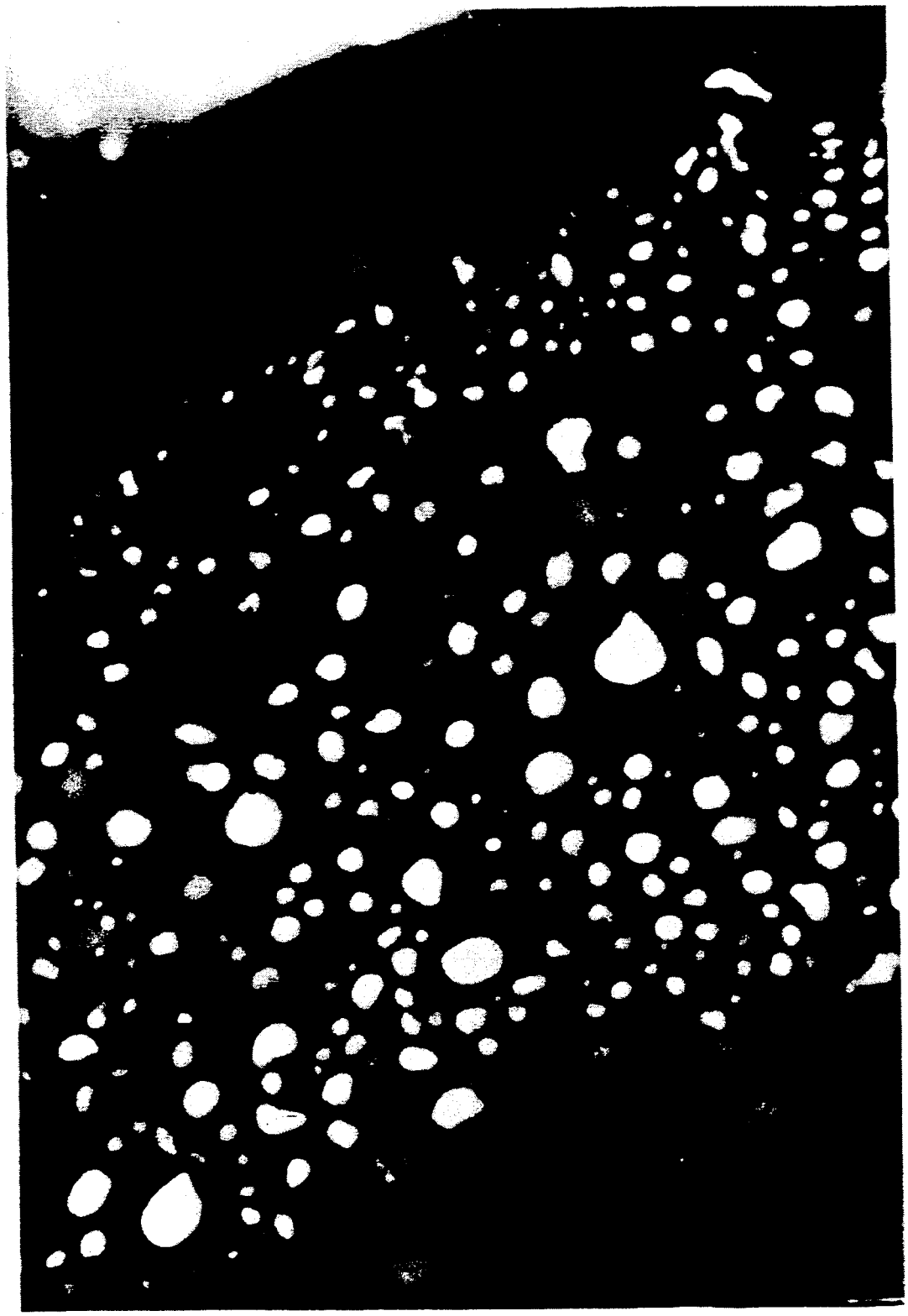
FIG. 10 is a TEM photograph of a cross section of the reversible thermosensitive recording material prepared in Comparative Example.

FIG. 10 is a TEM photograph of a cross section of the reversible thermosensitive recording material prepared in Comparative Example.

TABLE 1

| | Average Particle Diameter (μm) | Average Particle Diameter near the Surface (μm) | Average Particle Diameter near the Support (μm) |
|---|---|---|---|
| Ex. 1 | 0.3 | 0.2 | 0.45 |
| Ex. 2 | 0.20 | 0.05 | 0.3 |
| Ex. 3 | 0.25 | 0.2 | 0.3 |
| Ex. 4 | 0.3 | 0.2 | 0.35 |
| Ex. 6 | 0.35 | 0.05 | 0.3 |
| Comp. Ex. | 0.33 | 0.33 | 0.35 |

In Examples 1 to 7, the reversible thermosensitive recording layer(s), the intermediate layer and the protective layer can be uniformly overlaid. In contrast to this, in Comparative Example, when the intermediate layer was overlaid on the thermosensitive recording layer, cracks were formed on the surface of the thermosensitive recording layer, and the overlaid protective layer was not glossy.

In addition, the reversible thermosensitive recording materials and the comparative reversible thermosensitive recording material were subjected to an adherence test using an adhesive tape to evaluate the adhesion properties between the support and the thermosensitive recording layer in the manner described in the Japanese Industries Standards. As a result, in Examples 1 to 7, the thermosensitive recording layer was not peeled from the support. In Comparative Example, however, the thermosensitive recording layer was eminently peeled from the support.

In addition, thermal energy was applied to the recording layer of each reversible thermosensitive recording material for image formation using a thermal head, and the milky white opaque image was formed thereon, with a recording density of 8 dot/mm, and the image was then erased using a heat roller. After 100-times repetition of the image formation and erasure under the same conditions, the image density and the adhesion of dust to the thermal head were inspected. The results are shown in Table 2.

TABLE 2

| | Transparent Density at Initial Stage | Opaque Density at Initial Stage | Transparent Density after 100-times Operation | Opaque Density after 100-times Operation | Dust Deposition after 100-times Operation |
|---|---|---|---|---|---|
| Ex. 1 | 1.66 | 0.38 | 1.70 | 0.47 | none |
| Ex. 2 | 1.64 | 0.35 | 1.66 | 0.43 | none |
| Ex. 3 | 1.59 | 0.33 | 1.64 | 0.43 | none |
| Ex. 4 | 1.65 | 0.40 | 1.70 | 0.46 | none |
| Ex. 5 | 1.66 | 0.40 | 1.69 | 0.47 | none |
| Ex. 6 | 1.66 | 0.38 | 1.72 | 0.48 | none |
| Ex. 7 | 1.65 | 0.40 | 1.70 | 0.46 | none |
| Comp. Ex. | 1.27 | 0.35 | 0.91 | 0.69 | occurred |

Table 2 demonstrates that, in the reversible thermosensitive recording materials according to the present invention, the whiteness degree of the image is little degraded, the image contrast can be maintained, the organic low-molecular-weight material do not migrate and dust does not adhere to a thermal head. This is because the organic low-molecular-weight material in the form of particles are substantially covered with the matrix resin, and the content of the organic low-molecular-weight material increases from the surface of the thermosensitive recording layer toward the support.

What is claimed is:

1. A reversible thermosensitive recording material comprising a support, and a reversible thermosensitive recording layer formed thereon, having a reversible temperature-dependent transparency, which comprises a matrix resin and an organic low-molecular-weight material, said organic low-molecular-weight material being in the form of particles, and substantially being covered by said matrix resin, and the content thereof in said reversible thermosensitive recording layer being increased from the surface side thereof toward said support.

2. The reversible thermosensitive recording material as claimed in claim 1, wherein 88% or more of the entire amount of said organic low-molecular-weight material contained in said reversible thermosensitive recording layer is contained in the region of 4/5 of the entire thickness of said reversible thermosensitive recording layer measured from said support.

3. The reversible thermosensitive recording material as claimed in claim 1, wherein said organic low-molecular-weight material is contained in the region of 29/30 of the entire thickness of said reversible thermosensitive recording layer measured from said support.

4. The reversible thermosensitive recording material as claimed in claim 1, wherein said organic low-molecular-weight material has an average particle diameter in the range of 0.05 μm to 5.0 μm.

5. The reversible thermosensitive recording material as claimed in claim 1, wherein said reversible thermosensitive recording layer comprises at least two thermosensitive recording layers which are overlaid on each other, one on the surface side of said reversible thermosensitive recording layer, and the other on the side of said support, the content of said organic low-molecular-weight material in said thermosensitive recording layer on the side of said support being larger than that in said thermosensitive recording layer on the side of said reversible thermosensitive recording layer.

6. The reversible thermosensitive recording material as claimed in claim 5, wherein said thermosensitive recording layer on the surface side of said reversible thermosensitive recording layer becomes transparent at a temperature higher than the temperature at which said thermosensitive recording layer on the side of said support becomes transparent.

7. The reversible thermosensitive recording material as claimed in claim 1, wherein the average particle diameter of said organic low-molecular-weight material in said reversible thermosensitive recording layer increases from the surface side thereof to the side of said support.

8. A method of producing a reversible thermosensitive recording material comprising a support, and a reversible thermosensitive recording layer formed thereon, having a reversible temperature-dependent transparency, which comprises a matrix resin and an organic low-molecular-weight material, said organic low-molecular-weight material being in the form of particles, and substantially being covered by said matrix resin, and the content thereof in said reversible thermosensitive recording layer being increased from the surface thereof toward said support, comprising the steps of:

coating a solution or dispersion of said matrix resin and said organic low-molecular-weight material on said support, which are dissolved or dispersed in a mixed solvent comprising at least two solvents, each having a different vapor pressure, and drying said solution or dispersion.

9. The method as claimed in claim 8, further comprising a step of heating said support to a predetermined temperature prior to said step of coating said solution or dispersion on said support.

* * * * *

UNITED STATES PATENT AND TRADEMARK OFFICE

CERTIFICATE OF CORRECTION

PATENT NO. : 5,219,820

DATED : June 15, 1993

INVENTOR(S) : Kunichika Morohoshi, et al

It is certified that error appears in the above-indentified patent and that said Letters Patent is hereby corrected as shown below:

Column 3, Lines 64-65, "low-molecular-weight martial", should read --low-molecular-weight material--

Column 5, Line 7, "vice versa. becomes different.", should read --vice versa, becomes different.--

Column 5, Line 58, "toward the support side", should read --toward the support side.--

Column 6, Line 65, "present invention ca", should read --present invention can--

Column 6, Line 66, "vise versa", should read --vice versa--

Column 9, Line 17, "layer is no formed", should read --layer is not formed--

Signed and Sealed this

Eighteenth Day of October, 1994

Bruce Lehman

*Attest:*

BRUCE LEHMAN

*Attesting Officer*

*Commissioner of Patents and Trademarks*